United States Patent [19]

Griffin et al.

[11] 4,262,269

[45] Apr. 14, 1981

[54] Q ENHANCED RESONATOR

[75] Inventors: Edward L. Griffin; Frederick A. Young, both of Huntington Beach; Harvey M. Endler, Los Angeles, all of Calif.

[73] Assignee: Hughes Aircraft Company, Culver City, Calif.

[21] Appl. No.: 101,951

[22] Filed: Dec. 10, 1979

[51] Int. Cl.[3] ..... H01P 1/203; H01P 7/08

[52] U.S. Cl. ..... 333/204; 333/222

[58] Field of Search ..... 333/219, 222, 204, 116; 330/53, 56, 286; 331/96, 107 DP, 107 SL

[56] References Cited

U.S. PATENT DOCUMENTS

| | | | |
|---|---|---|---|
| 3,514,711 | 5/1970 | Fjallbrant | 330/53 |
| 4,129,842 | 12/1978 | Torii et al. | 333/219 X |

*Primary Examiner*—Paul L. Gensler

*Attorney, Agent, or Firm*—John Holtrichter, Jr.; W. H. MacAllister

[57] ABSTRACT

An active microwave filter for use in both bandpass and notch filter applications is herein described, the filter incorporating a distributed resonator to which is coupled an amplifier which provides a positive feedback and cancels the net dissipation in the resonator.

10 Claims, 4 Drawing Figures

Q ENHANCED RESONATOR

TECHNICAL FIELD

This invention relates to active filters and more particularly to such filters using a distributed reasonator .

BACKGROUND ART

There are many applications and a great need for resonators exhibiting high Q characteristics, especially in the microwave frequency range. These resonators are often used in filter circuits which provide a deep notch in the response curve or a bandpass response.

In the past, microwave filter circuits generally used high-Q passive waveguide and coaxial resonators which were usually heavy and bulky. This has been a serious limiting factor since many desirable applications of microwave filters require that the size be small and the weight, low.

In order to overcome this problem, attention has been directed at using active filter techniques, in order to reduce the bulk and weight factor. Microwave resonators using bipolar transistors have been designed and constructed, but they have generally not been put to practical use because of instability and noise problems. A reference which may be referred to in this regard is an article by D. K. Adams and R. Y. Ho, entitled "Active Filters for UHF and Microwave Frequencies," IEEE MTT-17, September 1969. It should therefore be evident that a new technique that permits the replacement of high-Q waveguide and coaxial filters by active MIC filters, with reductions of weights and volumes by large factors, would constitute a significant advancement in the art.

SUMMARY OF THE INVENTION

In view of the foregoing factors and conditions characteristic of the prior art, it is a primary object of the present invention to provide a new and improved Q enhanced resonator.

Another object of the present invention is to provide a technique which will allow the replacement of high-Q waveguide and coaxial filters for a reduction in weight and volume by large factors.

Still another object of the present invention is to provide a stable and extremely efficient Q enchanced resonator design that is adaptable for use in both bandpass filter and notch filter designs.

Yet another object of the present invention is to provide a Q enhanced resonator which combines a passive MIC resonator with a FET amplifier in such a manner that the FET circuitry gain compensates for the dissipation in the half wavelength MIC resonator, and thus greatly enhancing the unloaded Q.

Still a further object of the present invention is to provide a Q enhanced MIC resonator in a notch filter configuration which exhibits an unloaded Q in the four gigahertz region that exceeds 5000.

In accordance with an embodiment of the present invention, a Q enhanced resonator is provided for use in notch filter and bandpass filter applications, and the like. This embodiment includes a distributed resonator having adjacent but spaced ends, which resonator is coupled to a radio frequency transmission media. Also included, is an amplifier coupled to the spaced ends of the resonator for providing a positive feedback and to cancel the net dissipation in the resonator.

The invention may be advantageously implemented using microwave integrated circuitry (MIC), for example, where the resonator is a conductive coating or layer disposed on a first planar surface of a thin dielectric substrate, and where a conductive ground plane is disposed on the opposite planar surface. Preferably, the amplifier is an inverting FET amplifier and the resonator is generally in the shape of a C and represents a half wavelength at the operating frequency of the filter.

The features of the present invention which are believed to be novel are set forth with particularity in the appended claims. The present invention, both as to its organization and manner of operation together with further objects and advantages thereof, may best be understood by making reference to the following description taken in conjunction with the accompanying drawings in which like reference characters refer to like elements in the several views.

DETAILED DESCRIPTION OF THE INVENTION

Figure 1:
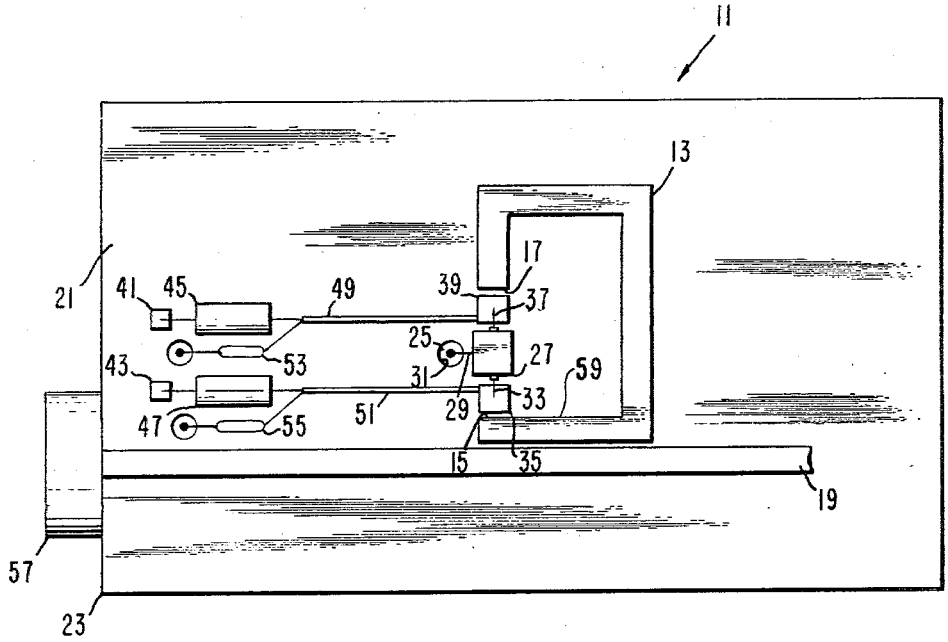
FIG. 1 is a plan view illustrating a presently preferred embodiment of a notch filter implementation of a Q enhanced resonator in accordance with the present invention.

Referring now to the drawings and more particulary to FIG. 1, there is shown a MIC-implemented notch filter circuit 11 utilizing a Q enhanced resonator 13 constructed in accordance with the invention. The resonator 13 is here constructed generally in the form of a square C having adjacent but spaced ends 15 and 17, and is designed to be a half wavelength at the desired frequency of the notch.

This MIC construction includes a mainline conductor 19 and the resonator 13 desposited or otherwise disposed on a first planar surface 21 of a dielectric substrate 23, and a broad ground plane 25 on the opposite planar surface.

Between the ends 15 and 17 of the half wavelength resonator 13 is disposed an inverting amplifier, such as an FET amplifier 27 in a grounded source configuration, for example. Here, the source electrode 29 is connected to the ground plane 25 through a hole 31 in the substrate 23, and a gate electrode 33 is connected to an input coupling conductive pad 35, and a drain electrode 37 is connected to an output coupling conductive pad 39.

Proper operating potentials are provided to the FET 27 by means of gate and drain conductive source pads 41 and 43, respectively, which lead through isolation resistors 45 and 47 to respective conductive gate and drain potential lines 49 and 51. Of course, RF bypass capacitors 53 and 55 are connected at the respective junctions of the resistors and potential lines and the ground plane 25 to prevent RF energy from reaching the potential sources (not shown), which sources are connected to the source pads 41 and 43.

In operation, gate and drain potentials are applied to the FET amplifier 27 and a microwave signal is coupled through a conventional port fixture 57 to propagate along the mainline 19 toward the resonator 13. With proper adjustment of the operating potentials and the spacing between a lower leg 59 of the resonator 13 and the mainline conductor 19, and between the gate and drain pads 35 and 39 and the associated adjacent ends 15 and 17 of the resonator, a positive feedback is provided in the active resonator circuit to cancel the net dissipation in the resonator. The gain and coupling is such that the system has no tendency to oscillate as long as the net resistance in the resonator circuit, including the transfer source impedance, is positive.

Figure 2:
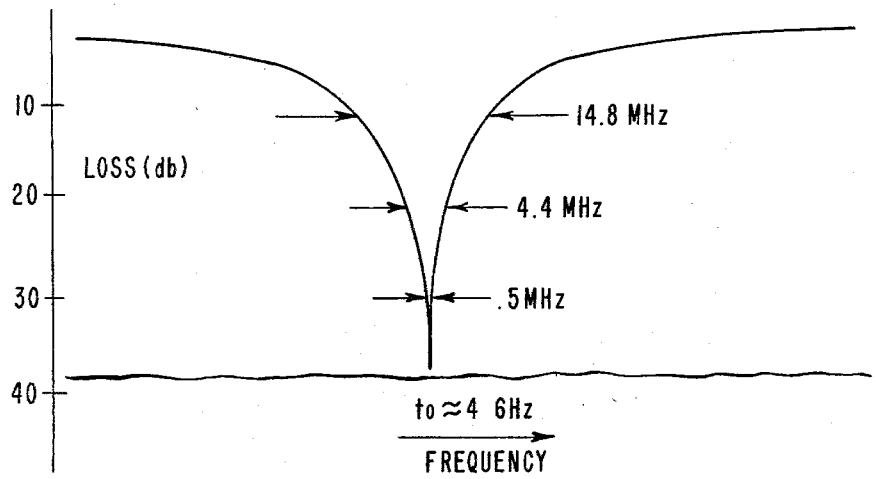
FIG. 2 is a graph showing the insertion loss vs. frequency of the embodiment of the invention shown in FIG. 1.

In a single cavity notch filter constructed as shown in FIG. 1, on 0.030 inch thick duroid MIC with a NEC 244 FET, the notch filter insertion loss was found to be as shown in FIG. 2. The unloaded Q of the circuit operating in the 4 gigahertz region exceeded 5000, while a passive MIC resonator exhibited an unloaded Q of only 200.

It should be appreciated that although the distributed resonator 13 has been described as being a half wavelength device, the resonator may be any odd number of half wavelengths for use with an inverting amplifier. Alternately, the resonator may be any even number of half wavelengths where the amplifier is non-inverting. Thus, the main criterion is that a positive feedback is provided in the system.

Figure 3:
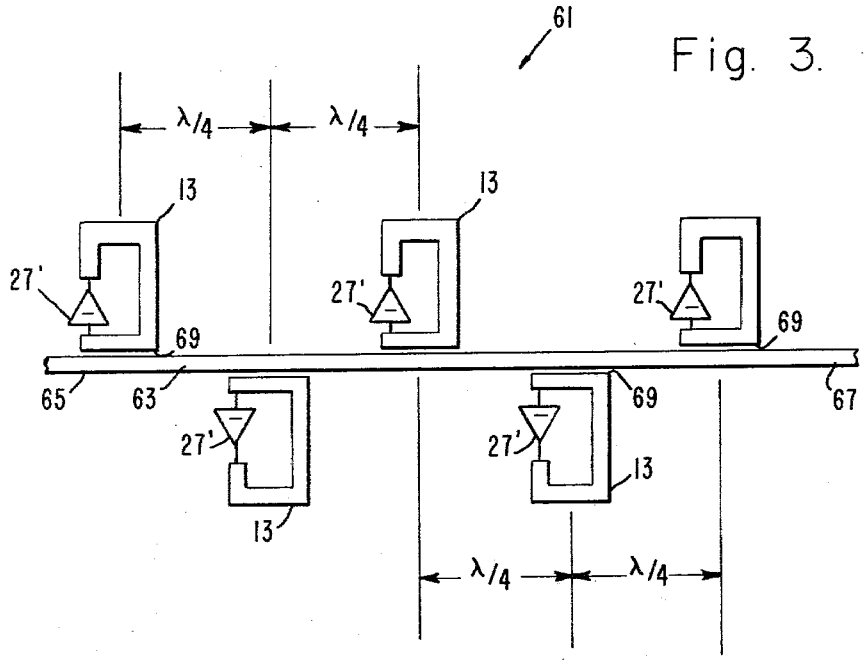
FIG. 3 is a schematic illustration of a 5-section Q enhanced resonator notch filter constructed in accordance with the present invention.

In accordance with another notch filter embodiment of the present invention, a plurality of distributed resonators may be utilized in order to provide the loss characteristic desired, as is well-known in the art. As shown in FIG. 3, a notch filter circuit 61 includes five Q enhanced resonators 13 of the type described above disposed along an RF transmission media 63 having an input end 65 and an output end 67. Here, the resonators are spaced one quarter wavelength apart and, for convenience, adjacent resonators are disposed on opposite sides of the transmission media. In adjusting the positioning of the resonators, it must be kept in mind that the coupling between each resonator and the mainline 63 is determined by the gap spacing 69.

Figure 4:
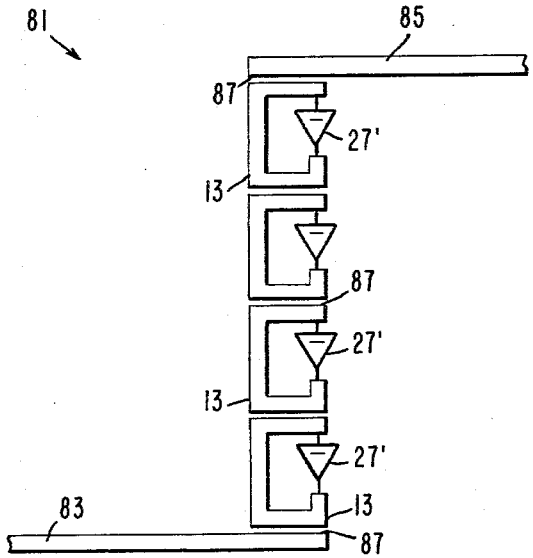
FIG. 4 is a schematic drawing of a 4-section bandpass MIC implemented embodiment of the invention.

On the other hand, where it is desired to use the invention's Q enhanced resonators in a bandpass configuation, one or more such resonators may be coupled between input and output RF transmission lines. For example, referring now to the bandpass circuit 81 of FIG. 4, it can be seen that four Q enhanced resonators 13 are coupled together serially between an input RF transmission line 83 and an output RF transmission line 85. Here again, the couplings between the resonators may be adjusted by varying the gap spacings 87. It should here be noted that, for the sake of simplicity, the amplifier circuitry in each of the Q enhanced resonators depicted in FIGS. 3 and 4 are represented by a triangular amplifier symbol 27'.

In view of the foregoing, it should be evident that there has herein been described a new and useful Q enhanced resonator that is advantageously utilized in both notch and bandpass filter circuits, and which is relatively easy to construct using conventional techniques, for an overall reduction in weight and volume over the prior art. Although this type of circuit has a relatively low power handling capability and a somewhat less than optimum noise figure, it still has less than a 10 dB noise figure and constitutes a significant advancement in the art.

It should further be understood that the abovedescribed embodiments are merely illustrative of but a small number of many possible specific embodiments which can represent applications of the principles of the present invention. Numerous and varied other arrangements can be readily devised in accordance with these principles by those skilled in the art without departing from the spirit and scope of the invention.

What is claimed is:

1. A Q enhanced resonator for use in notch filter and bandpass filter applications, and the like, comprising:

a radio frequency transmission media;

a distributed resonator having adjacent but spaced ends, said resonator being coupled to said transmission media; and amplifier means coupled to said spaced ends of said resonator for providing a positive feedback and to cancel the net dissipation in said resonator.

2. The Q enhanced resonator according to claim 1, wherein said distributed resonator is disposed adjacent to but spaced a predetermined distance from said transmission media.

3. The Q enhanced resonator according to claim 1, wherein said distributed resonator is generally C-shaped.

4. The Q enhanced resonator according to claim 1, also comprising a substrate, and wherein said distributed resonator and said transmission media are adjacently disposed but in spaced relationship on said substrate.

5. The Q enhanced resonator according to claim 1, wherein said distributed resonator is an odd number of half wavelengths in length, and wherein said amplifier means includes an inverting amplifier.

6. The Q enhanced resonator acccording to claim 1, wherein said distributed resonator is an even number of half wavelengths in length, and wherein said amplifier means includes a non-inverting amplifier.

7. The Q enhanced resonator according to claim 1, wherein said amplifier means includes a FET amplifier circuit.

8. The Q enhanced resonator according to claim 1, wherein said distributed resonator, said transmission media and said amplifier means are in a microwave integrated circuit (MIC) configuration and are all disposed on a MIC substrate.

9. The Q enhanced resonator according to claim 1, wherein said distributed resonator is coupled to said transmission media on one side of said distributed resonator in a notch filter circuit.

10. The Q enhanced resonator according to claim 1, wherein said transmission media includes an input transmission line and an output transmission line, and wherein said transmission lines are coupled to opposite sides of said distributed resonator.

* * * * *